US006543645B2

(12) United States Patent
Lacout

(10) Patent No.: US 6,543,645 B2
(45) Date of Patent: Apr. 8, 2003

(54) DEVICE AND METHOD FOR SAMPLING AND MIXING PRODUCTS

(75) Inventor: Frank Lacout, Draveil (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/810,189

(22) Filed: Mar. 19, 2001

(65) Prior Publication Data

US 2002/0030064 A1 Mar. 14, 2002

(30) Foreign Application Priority Data

Mar. 17, 2000 (FR) ..... 00 03467

(51) Int. Cl.[7] ..... A45D 19/02; B05C 17/005

(52) U.S. Cl. ..... 222/129; 222/478; 222/482; 206/219; 206/221; 206/568; 215/DIG. 8

(58) Field of Search ..... 222/129, 145.1, 222/145.5, 145.6, 478, 481, 482, 484–486; 206/219, 221, 568; 215/DIG. 8

(56) References Cited

U.S. PATENT DOCUMENTS

| | | | | |
|---|---|---|---|---|
| 2,753,990 A | * | 7/1956 | Chalfin | 206/221 |
| 3,093,267 A | * | 6/1963 | Lowery | 222/482 |
| 3,125,135 A | * | 3/1964 | Boyer et al. | 222/482 |
| 4,634,252 A | * | 1/1987 | Jeremijevic | 222/129 |
| 5,277,303 A | | 1/1994 | Goyet et al. | |
| 5,292,039 A | * | 3/1994 | Neofitou | 222/482 |
| 5,564,600 A | | 10/1996 | Renault | |
| 5,647,481 A | | 7/1997 | Hundertmark et al. | |
| 5,908,107 A | | 6/1999 | Baudin | |
| 6,148,995 A | | 11/2000 | De Laforcade | |

FOREIGN PATENT DOCUMENTS

| | | |
|---|---|---|
| EP | 0 918 023 | 5/1999 |
| GB | 2 280 657 | 2/1995 |

* cited by examiner

*Primary Examiner*—J. Casimer Jacyna
(74) *Attorney, Agent, or Firm*—Finnegan, Henderson, Farabow, Garrett & Dunner, L.L.P.

(57) ABSTRACT

A device is provided for mixing at least two products to form a mixture. The device may include a first compartment configured to contain a first product, a second compartment configured to contain a second product, and a sealing arrangement isolating the first compartment from the second compartment when the device is in a storage position. The first compartment may include a dispensing orifice capable of dispensing a mixture of the first product and the second product. The sealing arrangement may be actuatable to place the first compartment and the second compartment in flow communication with one another and thereby enable mixing of the first product and the second product to form the mixture. The second compartment may include a sampling orifice to enable the withdrawal of a sample of the second product from the second compartment prior to the mixing of the first product and the second product. Alternatively, the sampling orifice is provided on the first compartment to enable sampling of the first product. A method may also be practiced with the device to sample and mix the two products.

71 Claims, 7 Drawing Sheets

X
6
7
5
4
3
2
101'
100'
O
70
64
71
50
65
66
40
13
10
14
37
52
11
12
20
106
38
39
21
34
33
31
30
D
32

DEVICE AND METHOD FOR SAMPLING AND MIXING PRODUCTS

DESCRIPTION OF THE INVENTION

The present invention relates, in general, to a device for the mixing of at least two products to form a mixture and for dispensing the mixture obtained. More particularly, the present invention could be embodied in the form of a device for preparing and applying a hair dye product obtained by mixing an oxidizing agent and a dye. The present invention also relates to sampling one of the two products, and a method for sampling one of the two products.

BACKGROUND OF THE INVENTION

Generally, in the area of hair dyeing, the devices used for macking such mixtures include a structure having a first reservoir (generally formed by the upper part of the device) containing the oxidizing agent, and a second reservoir (generally formed by the lower part of the device) containing the dye. The first reservoir generally has an orifice equipped with a dispensing tip to allow localized application of the mixture produced. Before the mixing of the two products is performed, the two reservoirs are isolated from one another in a sealed manner by means of a shutter. The shutter may be disengaged automatically by use of an operating member. The device may be obtained by assembling two separate reservoirs made of identical or different materials. Alternatively, the two reservoirs may be molded to form a single piece.

In the area of hair dyeing, it is desirable for the user to be able to perform a strand test so as to make sure that the dye product is not harmful upon contact with her skin. Generally, this may be performed on a small area of the scalp. The conventional design of this type of device, where the dye is located in a second reservoir underneath a first reservoir containing the oxidizing agent, prevents the possibility of withdrawing such a test dose. In particular, the conventional device does not have a directly accessible opening in the second reservoir. In addition, if the dye is located in a reservoir capable of being accessed directly via the dispensing tip, a frangible member (e.g., a break away tab) on the dispensing tip sometimes needs to be removed in order to remove the dye product alone. Hence, often times, a small bottle containing a small amount of the dye product is packaged with the dye device. This small bottle, aside from the additional space it takes up in the final packing of the device, increases the overall cost of the final packaged assembly.

SUMMARY

Therefore, one aspect of the invention relates to a mixing device that makes it possible to solve all or some of the problems discussed hereinabove with reference to the conventional devices.

Another aspect of the invention relates to a mixing device with two superposed compartments that allows a sample to be withdrawn.

Another aspect of the invention relates to a device that allows such a sample to be withdrawn, and which is simple and economical to produce.

Still other aspects of the invention will become apparent in the detailed description which follows. It should be understood that the invention could still be practiced without having one or more of the aspects or features described herein.

According to an aspect of the present invention, a device is provided for mixing at least two products to form a mixture. The device may include a first compartment configured to contain a first product, a second compartment configured to contain a second product, and a sealing arrangement isolating the first compartment from the second compartment when the device is in a storage position. The first compartment may include a dispensing orifice capable of dispensing a mixture of the first product and the second product. The sealing arrangement may be actuatable to place the first compartment and the second compartment in flow communication with one another and thereby enable mixing of the first product and the second product to form the mixture. The second compartment may include a sampling orifice to enable the withdrawal of a sample of the second product from the second compartment prior to the mixing of the first product and the second product. The device may be used to provide extemporaneous mixing of the at least two products.

The sampling orifice for withdrawing the sample may be an orifice distinct from a second orifice in the second compartment. The second orifice may form part of the sealing arrangement which allows the two products to be placed in contact with each other (i.e., an orifice through which the mixing of the products can occur). The second orifice of the second compartment may be generally inaccessible for withdrawal of a sample because of the irreversible mounting of the first compartment with respect to the second compartment. The second orifice may also be inaccessible because the first compartment and second compartment may have been produced as a single piece.

The sampling orifice for withdrawing the sample may be arranged so that the sampling orifice is above the free surface of the product contained in the second compartment. The relative positioning of the sampling orifice can be arranged for various positions of the device, for example, a head-down or a head-up position.

In another aspect, the device may further include a removable closure configured to close the sampling orifice. There are many different types of closures that could be used; for example, the removable closure may be a screw cap.

In yet another aspect, the device may further include at least one passage through which at least one of the first product and the second product passes to enable the mixing of the products. In this aspect, the sampling orifice may be separate from the passage.

In another aspect, the second compartment may be located below the first compartment.

In another aspect, the first and second compartments may be coupled to one another, and the device may be configured such that the sample of the second product may be withdrawn via the sampling orifice while the first compartment and second compartment are coupled to one another.

In still another aspect, the device has a longitudinal axis, and the sampling orifice is along a second axis separate from the longitudinal axis. For example, the second axis may be substantially parallel to the longitudinal axis. Alternatively, the second axis may define an oblique angle with respect to the longitudinal axis, for example, about a 45° angle. The sampling orifice for withdrawing the sample may also be formed along the axis or off the axis of the device, in the bottom of the second compartment. The sample may then be removed when the device has been inverted to a head-down position.

In a further aspect, the device may be configured to permit assembly of the first compartment and the second compartment to one another while substantially preventing disassembly of the first and second compartments. For example, the first compartment and the second compartment may be assembled by screw-fastening or snap-fastening. With such an arrangement, the device may be irreversibly assembled.

In yet another aspect, each of the first compartment and the second compartment may be formed of a single piece of material. For example, the first compartment and the second compartment may be formed of a thermoplastic material. Alternatively, at least one of the first compartment and the second compartment may be formed of glass. The other of the first compartment and the second compartment may be formed of thermoplastic material.

In still another aspect, the first compartment and the second compartment may be formed together as a single piece.

In another aspect, the device may have a longitudinal axis, and the first compartment and the second compartment may be aligned along the longitudinal axis.

In a further aspect, the device may include an adapter configured to be in flow communication with the dispensing orifice to dispense the mixture.

In yet another aspect, the device may include an applicator member configured to pass through the sampling orifice to withdraw the sample.

In another aspect, the device may include an applicator member provided on the closure. Additionally, the device may include the second product contained in the second compartment, and the applicator member may be at least partially immersed in the second product when the closure closes the sampling orifice. The applicator member may be chosen from a spatula, a brush, and a block of porous material. The brush may have either axial or non-axial bristles. The block of porous material may be formed of an elastically compressible material.

In another aspect, the present invention may include the first product, for example, an oxidizing agent, contained in the first compartment and the second product, for example, a dye, contained in the second compartment. The mixture may comprise a hair composition, for example, a dye composition. Alternatively, at least one of the first product and the second product may be a liquid.

By actuating the sealing arrangement, the first compartment and the second compartment may be automatically placed in communication with one another. There are numerous types of sealing arrangements that could be used on the device. An actuation of the sealing arrangement (e.g., a force and/or movement applied to the sealing arrangement) may enable the flow communication of the compartments. The actuation may cause tearing of a membrane associated with the sealing arrangement (e.g., by means of a trocar), expelling of a removable shutter associated with the sealing arrangement, and/or movement of a shutter between a first position wherein the compartments are sealed from one another and a second position wherein flow communication between the compartments is provided, for example. The sealing arrangement could be any known sealing arrangement.

In one aspect, the sealing arrangement may include a shutter. The shutter may be configured to be movable to enable the flow communication of the first compartment and the second compartment.

The actuation may be applied by means of an operating member distinct from the first compartment and the second compartment, or by an operating member formed on the first compartment or the second compartment.

An aspect of the present invention is directed to a method of sampling a product prior to mixture of the product with at least one other product. The method may include providing a device according to the present invention, wherein the device is in the storage position. The method also includes withdrawing from the second compartment a sample of the second product via the sampling orifice.

In another aspect, the withdrawing may include removing the sample of the second product from the second compartment with an applicator member, and applying the sample of the second product to a test surface with the applicator member.

In another aspect, the method may include applying the sample of second product to a test surface, wherein the test surface may be at least one of skin and hair.

In yet another aspect, at least one of the first product, the second product, and the mixture of the first and second products may be a cosmetic product. In a further aspect, the first product may include an oxidizing agent, the second product may include a dye, and the mixture may be a hair dye composition.

The present invention may be directed to a method of sampling a product and mixing the product with another product to form a mixture. The method may include sampling the second product according to the method described above, actuating the sealing arrangement to place the first compartment and the second compartment in flow communication, mixing the first product and the second product to form the mixture, and dispensing the mixture through the dispensing orifice.

In a further aspect, the mixture may be a hair composition, for example, the hair composition may be a dye composition, and the second product may be a dye.

In another variation, the present invention may also be directed to a device for mixing at least two products to form a mixture, wherein the sampling orifice may be formed on either the first compartment or the second compartment. The sampling orifice may enable withdrawal of either a sample of the first product from the first compartment or a sample of the second product from the second compartment, prior to the mixing of the first product and the second product.

In another aspect, the sampling orifice may be provided on the first compartment. In addition, the first and second compartments may be coupled to one another, and the device may be configured such that the sample of the first product is capable of being withdrawn from the first compartment via the sampling orifice while the first compartment and the second compartment are coupled to one another.

In another variation, the present invention may also be directed to a method of sampling a product prior to mixture of the product with at least one other product, where the method includes providing a device according to the variation described above. The device may be in the storage position. The method also includes withdrawing a sample of one of the first product and the second product via the sampling orifice.

In another aspect, the withdrawing includes withdrawing the sample of the first product.

In another variation, the present invention may also be directed to a method of sampling a product and mixing the product with another product to form a mixture, where the method includes sampling one of the first product and the second product according to the method described above. The method may also include actuating the sealing arrangement to place the first compartment and second compartment in flow communication, mixing the first product and the second product to form the mixture, and dispensing the mixture through the dispensing orifice.

Additional aspects of the invention will be set forth in part in the description which follows, and in part will be obvious from the description, or may be learned by practice of the invention. The aspects of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DETAILED DESCRIPTION OF THE EXEMPLARY EMBODIMENTS

Figure 1:
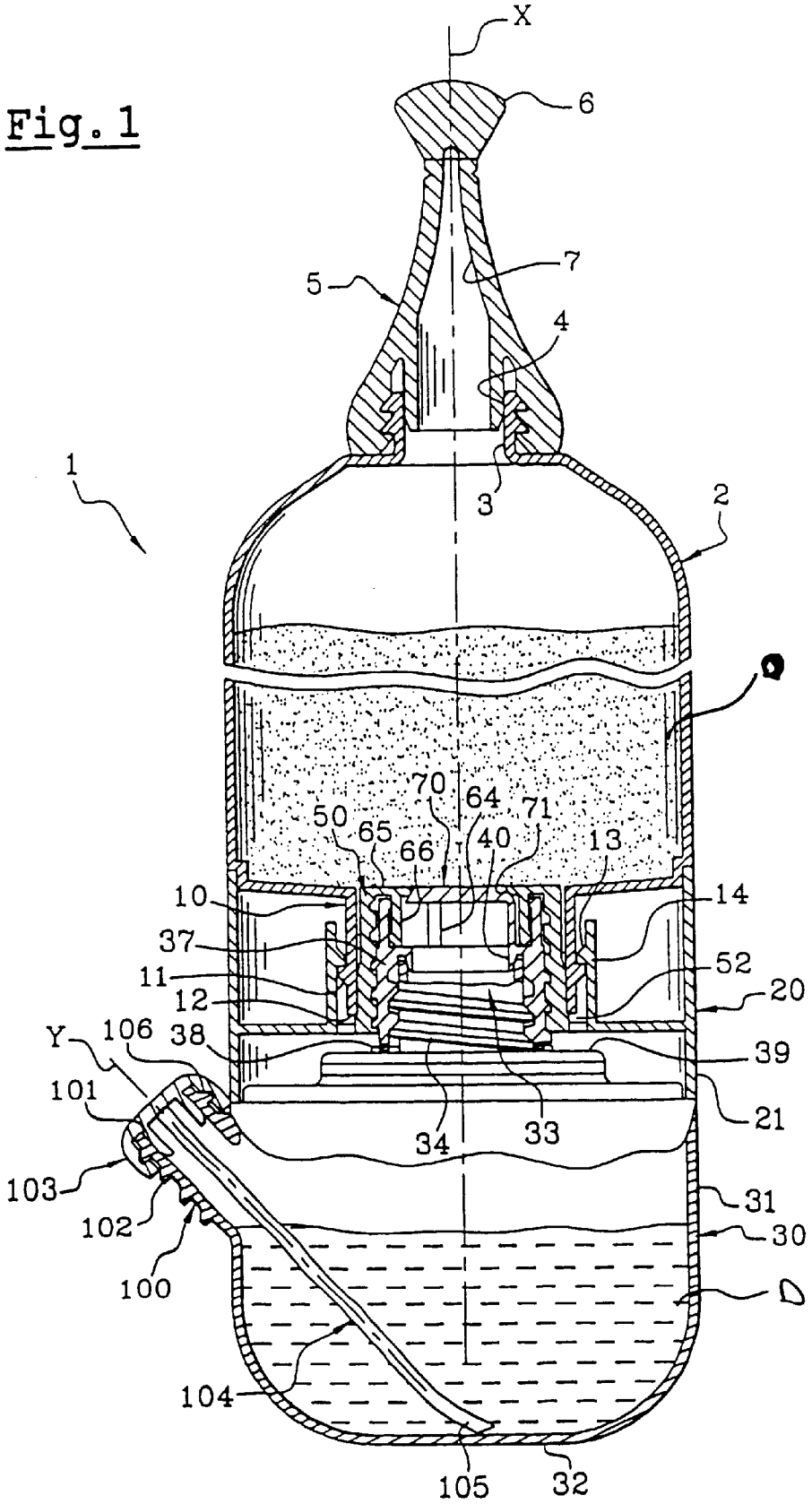
FIG. 1 is a longitudinal cross-section view of a first embodiment of a device in accordance with the present invention.

Reference will now be made in detail to the exemplary embodiments of the invention, examples of which are illustrated in the accompanying drawings. Wherever possible, the same reference numbers will be used throughout the drawings to refer to the same or like parts.

A device 1, shown in FIGS. 1 and 3, will be described with reference to the mixing of two products, a dye D and an oxidizing agent O. (It should be understood that the device may contain other substances in addition to these two products, and that the two products do not need to be a dye and an oxidizing agent). The mixing of the two products can form a dye composition known as an "oxidation dye". The device 1 comprises a first compartment 2 containing the oxidizing agent O. The first compartment 2 may include a neck 3 along the longitudinal axis X of the device 1. The neck 3 includes a free edge defining an opening or dispensing orifice 4.

Attached to the neck 3 is an applicator 5, which can be used for the localized application of the mixture of the products (e.g., the oxidation dye). The adapter 5 may be configured to provide a precise application of the mixture. The applicator 5 may be attached by any suitable means, such as by screw-fastening. The applicator 5 can end in a break-off tab 6, which can seal a duct 7 passing axially through the applicator 5. The break-off tab 6 is configured to be removed prior to dispensing of the mixture.

At an end of the compartment 2 opposite to the neck 3 and optionally centered on the axis X of the first compartment 2 is a second neck 10. The second neck 10 includes a free edge which defines an opening 12. The external surface of the neck 10 may have a snap-fit bead 11. The snap-fit bead 11 engages with a corresponding bead 13 formed on the internal surface of an axial shaft 14 included on an intermediate element 20. This allows the intermediate element 20 to be mounted on the first compartment 2 by a snap-fastening operation which (under normal conditions of use) may be irreversible. The intermediate element 20 comprises an external trim skirt 21 optionally having the appearance of being roughly a continuation of the body of the first compartment 2 and of the body of a second compartment 30, as shown in FIG. 1. The first compartment 2 and second compartment 30 may be aligned along the axis X of the device 1, and the first compartment 2 may be arranged above the second compartment 30.

The first compartment and/or second compartment may be formed by extrusion blow-molding.

The second compartment 30 has a body 31, which may have a cross-section substantially identical to the cross-section of the trim skirt 21 of the intermediate element 20. One end of the body 31 ends in a closed end 32, while the other end forms a neck 33. The external surface of neck 33 may include a screw thread 34. A free edge of the neck 33 defines an opening 35. The screw thread 34 of the neck 33 cooperates with a screw thread 36 provided on the internal surface of a fitting member 37. The internal surface of the fitting member 37 forms a lip 40 which, when the fitting member 37 has been screwed onto the neck 33, is capable of making a seal substantially around the opening 35 of the second compartment 30.

When the fitting member 37 is screwed onto the neck 33, the lower edge of the fitting member 37 engages with notchings 38 provided on the shoulder 39 of the compartment 30. The notchings 38 may prevent the fitting member 37 from being unscrewed from the neck 33. The exterior surface of the fitting member 37 includes a screw thread 41 over an axial portion of the fitting member 37 located between the lower edge of the fitting member 37 and the sealing lip 40. The screw thread 34 is capable of cooperating with a screw thread 51 formed on the internal surface of a skirt 50. The skirt 50 may be concentric with the axial shaft 14 of the intermediate element 20. The skirt 50 has an outside diameter smaller than the inside diameter of the axial shaft 14 so as to form a U-shaped annular space 52 capable of housing the neck 10 of the first compartment 2. The skirt 50 may be connected to the axial shaft 14 by a number of uniformly spaced tabs 53 formed near a lower end of the skirt 50.

The fitting of the skirt 50 into the neck 10 of the first compartment 2 by force and/or using grooved surfaces, prevents the intermediate element 20 from turning With respect to the upper compartment 2.

At an end opposite to the one including the attachment tabs 53, the skirt 50 is connected to a transverse flange 65 secured to a skirt 66. The skirt 66 may be concentric with the skirt 50 and may have an outside diameter smaller than the inside diameter of the skirt 50. The skirts 50 and 66 and the transverse flange 65 thus form an annular U-shaped groove 60, the closed end of which faces away from the closed end of the U-shaped groove 52. The annular groove 60 may accommodate a cylindrical skirt 61 which extends upward on the fitting member 37 beyond the sealing lip 40. Near a free end, the skirt 66 may include a bead 62 on a surface facing towards the inside of the U-shaped groove 60. The bead 62 may be capable of engaging with a bead 63 formed on the internal surface of the skirt 61, near its free end, so as to restrict the unscrewing of the fitting member 37 with respect to the skirt 50. This prevents the second compartment 30 from being detached from the intermediate element 20.

The fitting member 37 is secured via a number of tabs 64 to a shutter 70. The shutter 70 is capable of shutting off an orifice 71 delimited by the inner edge of the transverse flange 65 when the skirt 50 is screwed onto the fitting member 37. The edge of the orifice 71 may be chamfered to ensure sealed closure of the orifice by the shutter 70. The shutter 70 may have an edge which is profiled to correspond to the chamfered profile of the edge of the orifice 71.

Figure 3:
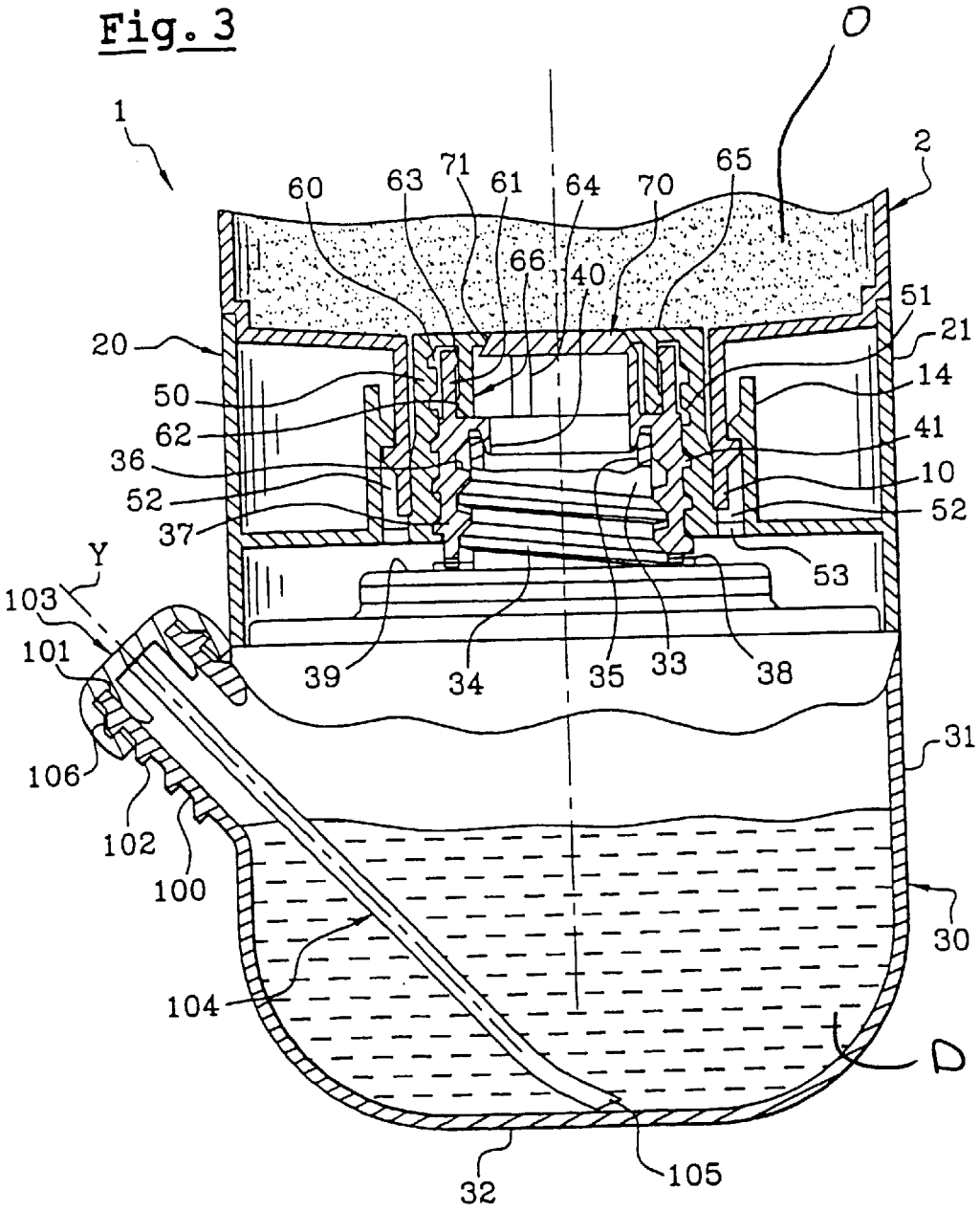
FIG. 3 shows a portion of the view of FIG. 1.

The fitting member 37, the skirts 50 and 66, transverse flange 65, and the shutter 70 of the embodiment shown in FIGS. 1 and 3 provide a sealing arrangement.

The way the two products may be mixed will be discussed hereinafter with reference to FIG. 4, which shows a second embodiment of the device.

Figure 6:
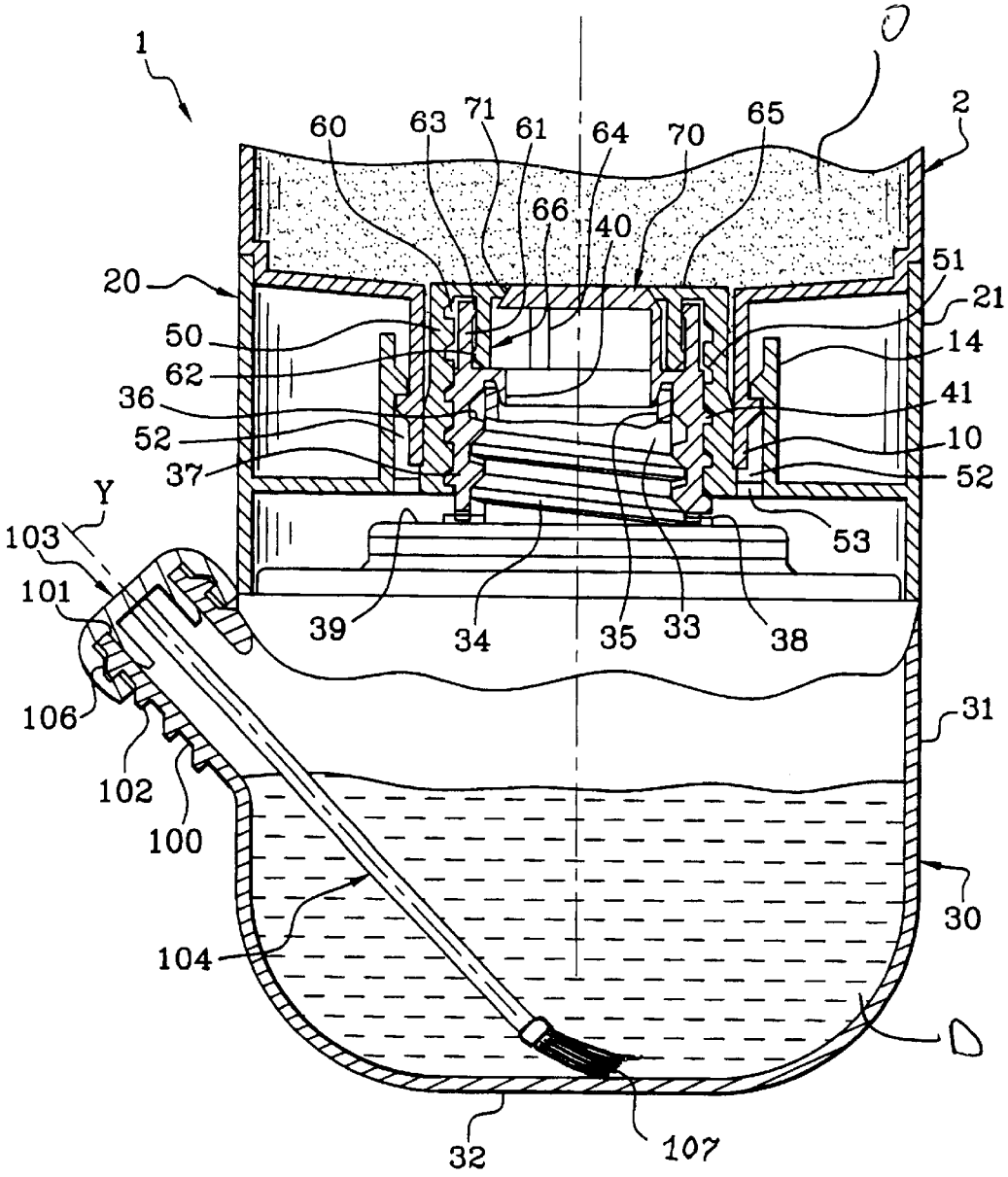
FIG. 6 is a view similar to that of FIG. 3 showing a brush applicator which could be used with the device.
Figure 7:
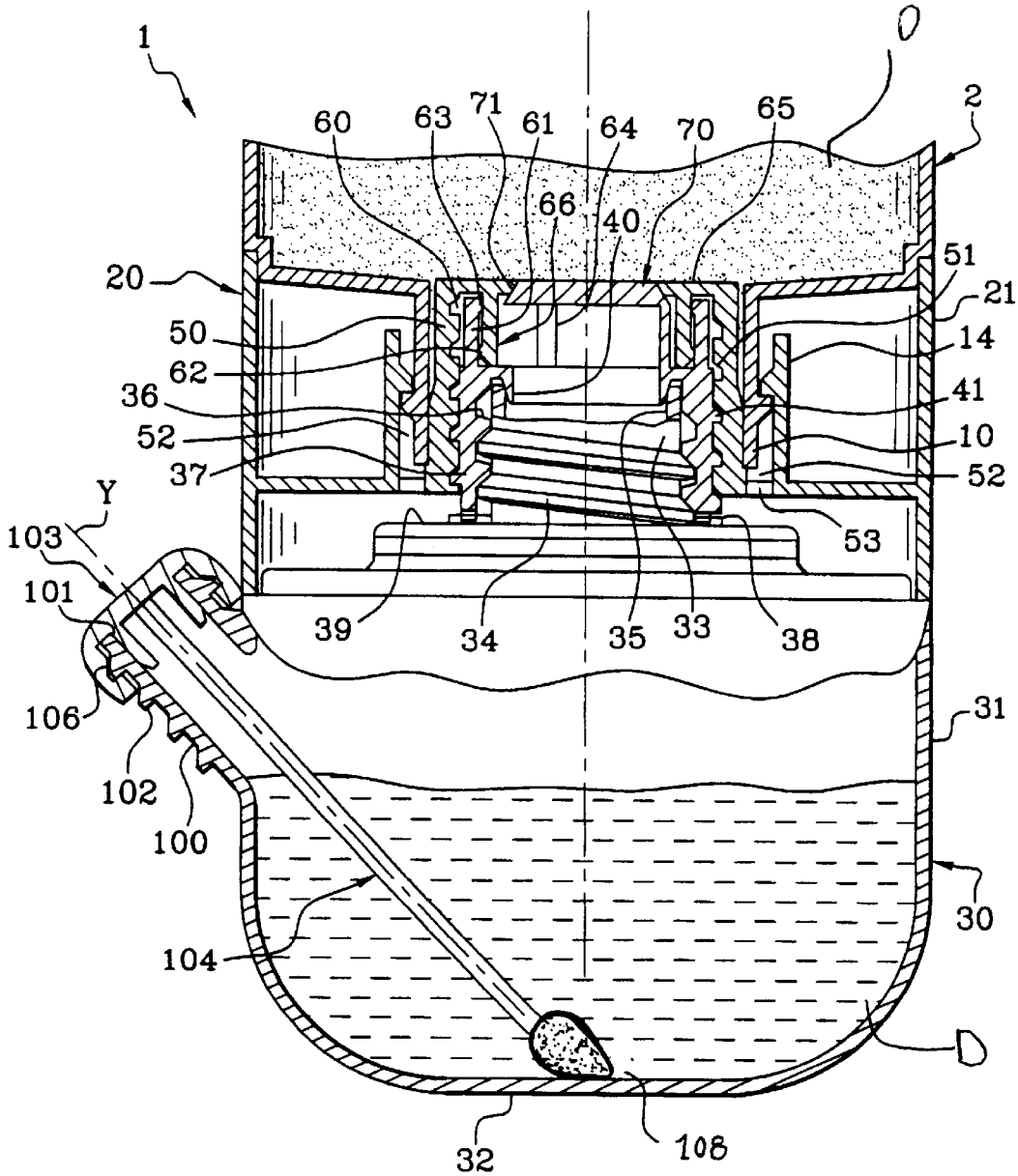
FIG. 7 is a view similar to that of FIG. 3 showing another alternative applicator which could be used with the device.

As shown in FIGS. 1 and 3, the second compartment 30 comprises a second neck 100 which includes a free edge defining an opening or sampling orifice 101. The neck 100 may be oriented along an axis Y inclined at about 45° with respect to the axis X of the device 1. The external surface of the neck 100 may have a screw thread 102 capable of cooperating with a corresponding screw thread 106 of a cap 103. The cap may be secured to an applicator member 104 along its axis Y. The applicator member 104 may be in the form of a spatula having a free end 105. The applicator member 104 may also be in the form of a brush 107, as shown in FIG. 6, or a block of porous material 108, as shown in FIG. 7. The block of porous material 108 may be a foam pad and the material may be elastically compressible. The free end 105, brush 107, or block of porous material 108, may be located at the bottom 32 of the second compartment 30 when the cap 103 covers the sampling orifice 101.

Before mixing the two products, the user may unscrew the cap 103 and withdraw a sample, which may be as little as a drop of product, using the applicator member 104. The user may then apply the sample to a test surface, for example, to ensure that the product will be harmless to the user's skin. Once satisfied, the user may reseal the orifice 101 using the cap 103, and proceed to mixing the two products in a way that will be described later with reference to FIG. 4.

Although reference has been made to the applicator 104 for withdrawing the sample, a sample may also be withdrawn via the sampling orifice 101 by pouring a drop of the dye product onto a finger, onto the surface that is to be treated, or onto any other appropriate transfer member.

Figure 2:
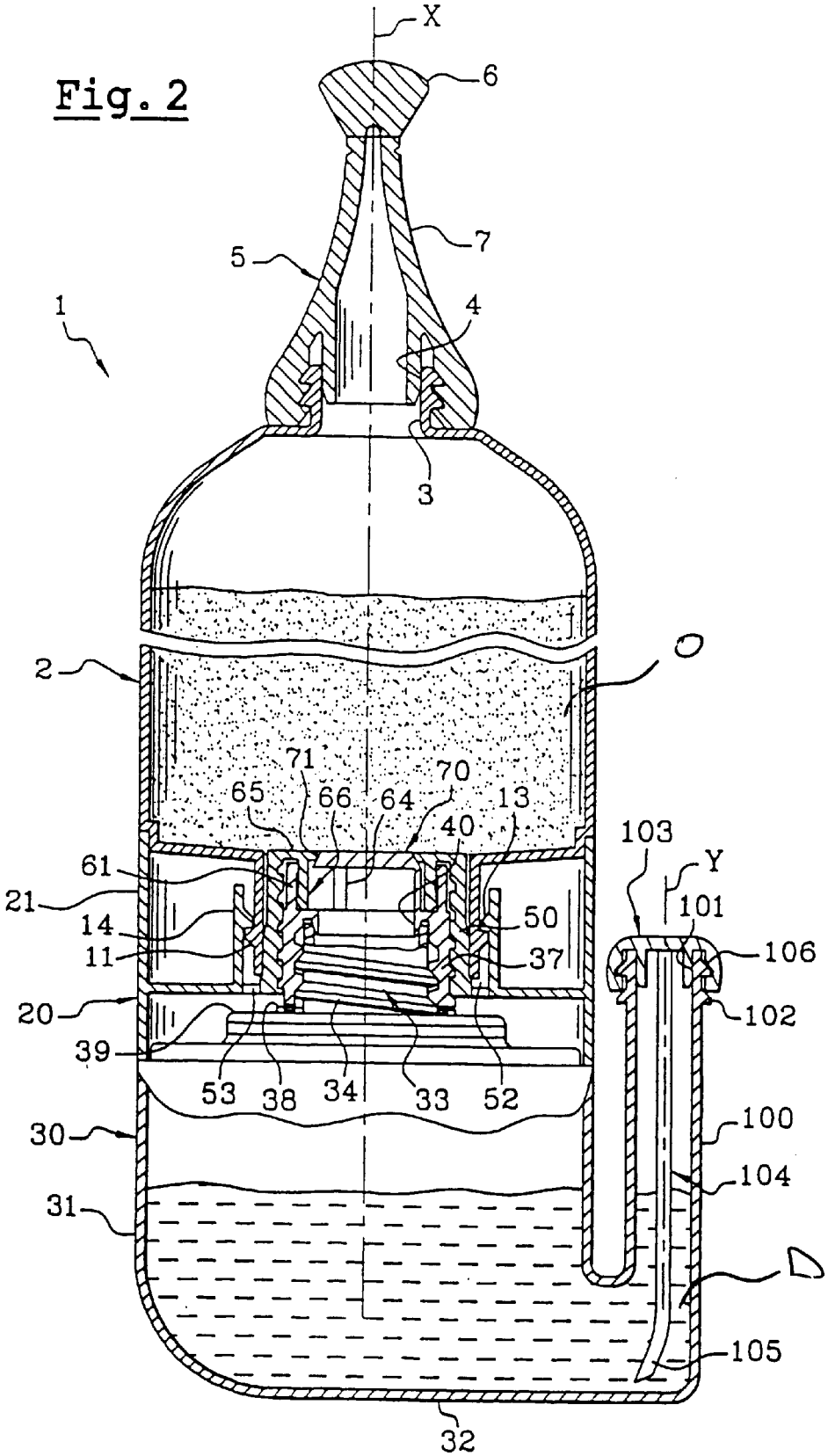
FIG. 2 is a longitudinal cross-section view of a second embodiment of a device.
Figure 4:
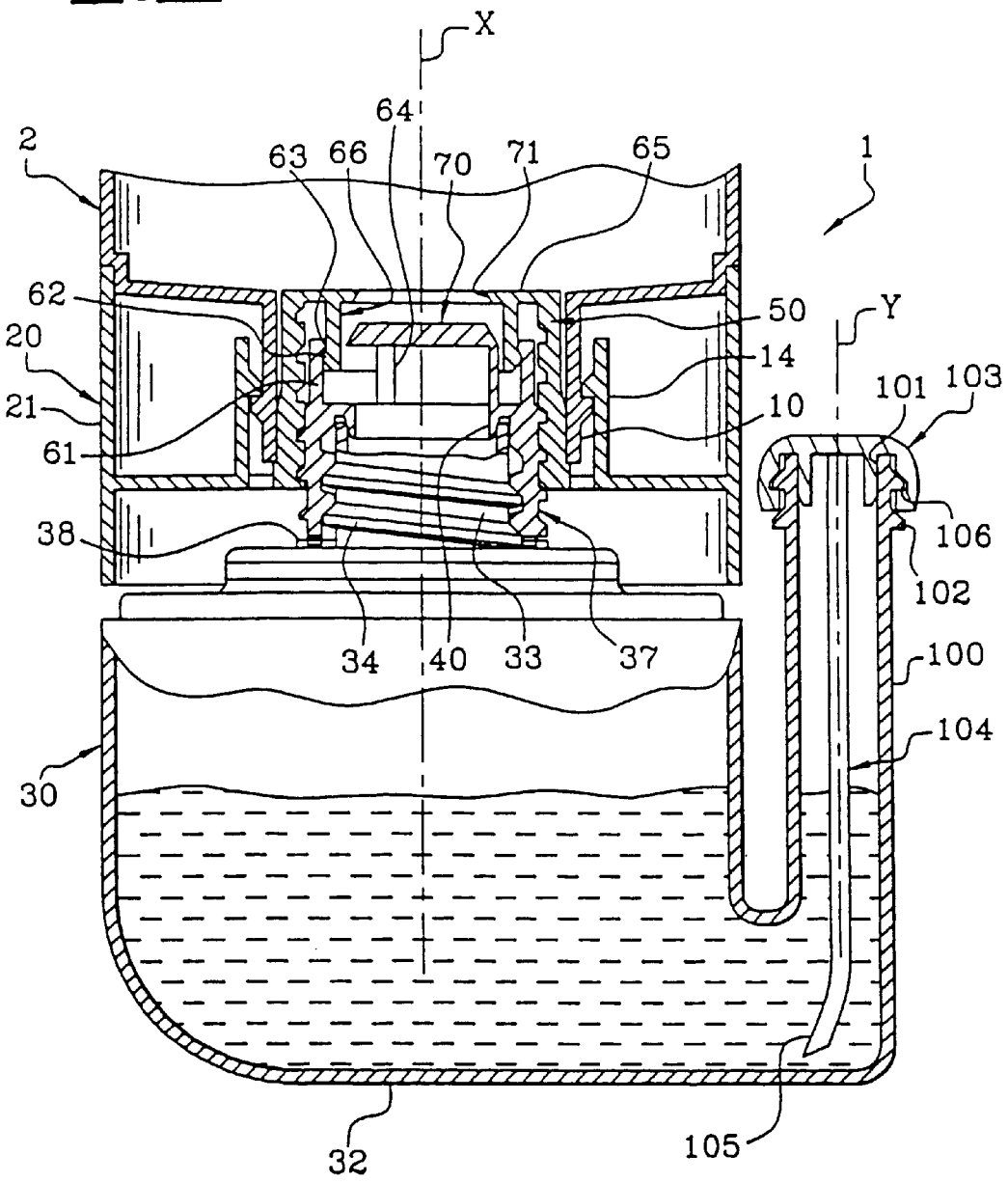
FIG. 4 shows a portion of the view of FIG. 2.

FIGS. 2 and 4 illustrate a second embodiment of the device. In this second embodiment, the neck 100 may be oriented along an axis Y substantially parallel to the axis X of the device. The remainder of the device 1 is in accordance with the embodiment discussed with reference to FIGS. 1 and 3 and therefore requires no additional description.

In any of the embodiments described above, the outlet orifice 101 may be formed at a level close to the level of the opening through which the two products are placed in communication with each other.

Figure 5:
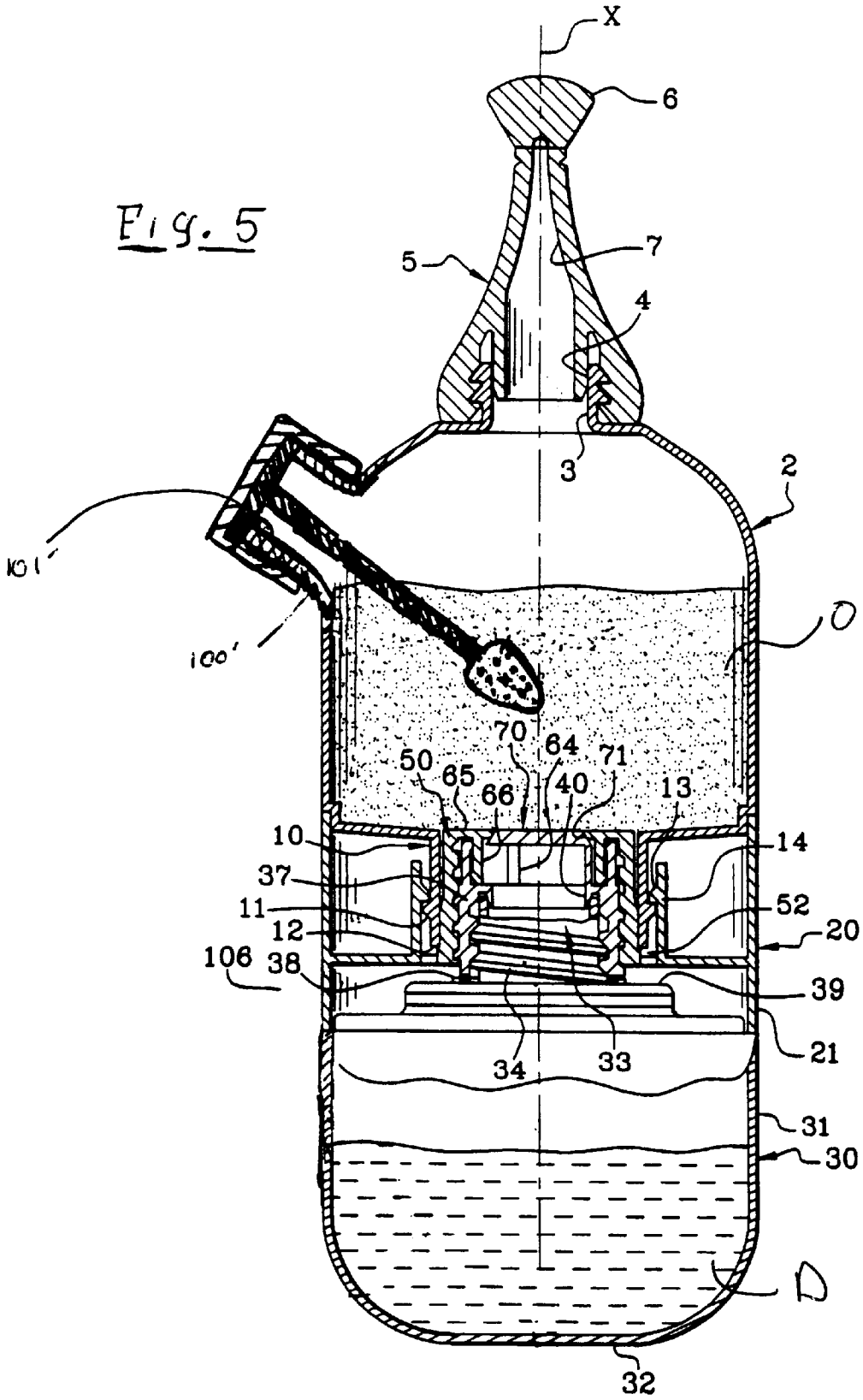
FIG. 5 is a longitudinal cross-section view of a third embodiment of a device.

FIG. 5 shows a third embodiment where the neck 100' is provided in the first compartment 2. In this arrangement, the product in the first compartment 2 may be sampled via the sampling orifice 101' without opening the applicator 5 prior to the mixing of the two products. The remainder of the device is in accordance with the embodiment discussed with reference to FIGS. 1 and 3 and therefore requires no additional description.

The mixing of the two products using a device according to one of the embodiments above will be discussed briefly with reference to FIG. 4. The user turns the second compartment 30 with respect to the first compartment 2, thereby moving the compartments out of the storage position. The first compartment 2 is coupled in terms of rotation to the intermediate element 20. By rotating the second compartment 30 with respect to the first compartment 2, the user unscrews the fitting member 37 with respect to the skirt 50 of the intermediate element 20 until the limit stop 62 of the skirt 66 engages with the limit stop 63 of the skirt 61. During this movement of unscrewing the fitting member 37 from the skirt 50 of the intermediate element 20, the shutter 70 -lifts off the seat formed by the edge of the transverse flange delimiting the orifice 71. The product contained in the first compartment 2 can then come into communication with the product contained in the second compartment 30 via the passage formed all around the shutter 70. The user then shakes the device 1 to homogenize the mixture. The mixture is then ready for use.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A device for mixing at least two products to form a mixture, the device comprising:

a first product;

a second product, wherein at least one of the first product, the second product, and a mixture of the first product and the second product comprises a cosmetic product, and wherein the first product and the second product are different products;

a first compartment containing the first product, the first compartment including a dispensing orifice capable of dispensing the mixture of the first product and the second product;

a second compartment containing the second product, wherein the second product contained in the second compartment is not pressurized;

a sealing arrangement isolating the first compartment from the second compartment when the device is in a storage position, the sealing arrangement being actuatable to place the first compartment and the second compartment in flow communication with one another and thereby enable mixing of the first product and the second product to form the mixture, wherein the second compartment comprises a sampling orifice for enabling withdrawal of a sample of the second product from the second compartment prior to the mixing of the first product and the second product; and at least one passage through which at least one of the first product and the second product passes to enable the mixing of the products, and wherein the sampling orifice is separate from the at least one passage.

2. The device according to claim 1, further comprising a removable closure configured to close the sampling orifice.

3. The device according to claim 2, wherein the removable closure is a screw cap.

4. The device according to claim 1, wherein the first and second compartments are coupled to one another, and wherein the device is configured such that the sample of the second product is capable of being withdrawn via the sampling orifice while the first compartment and the second compartment are coupled to one another.

5. The device according to claim 1, wherein the device has a longitudinal axis, and the sampling orifice is along a second axis separate from the longitudinal axis.

6. The device according to claim 5, wherein the second axis is substantially parallel to the longitudinal axis.

7. The device according to claim 5, wherein the second axis defines an oblique angle with respect to the longitudinal axis.

8. The device according to claim 7, wherein the oblique angle is about a 45° angle.

9. The device according to claim 1, wherein the device is configured to permit assembly of the first compartment and the second compartment to one another while substantially preventing disassembly of the first and second compartments.

10. The device according to claim 9, wherein the first compartment and the second compartment are assembled by screw-fastening.

11. The device according to claim 9, wherein the first compartment and the second compartment are assembled by snap-fastening.

12. The device according to claim 1, wherein each of the first compartment and the second compartment is formed of a single piece of material.

13. The device according to claim 12, wherein the first compartment and the second compartment are formed of a thermoplastic material.

14. The device according to claim 1, wherein at least one of the first compartment and the second compartment is formed of glass.

15. The device according to claim 1, wherein the first compartment and the second compartment are formed together as a single piece.

16. The device according to claim 1, wherein the device has a longitudinal axis, and the first compartment and the second compartment are aligned along the longitudinal axis.

17. The device according to claim 1, further comprising an adapter configured to be in flow communication with the dispensing orifice to dispense the mixture.

18. The device according to claim 1, wherein the second product comprises a dye.

19. The device according to claim 1, wherein the first product comprises an oxidizing agent.

20. The device according to claim 1, wherein the mixture comprises a hair composition.

21. The device according to claim 20, wherein the hair composition comprises a dye composition.

22. The device according to claim 1, wherein at least one of the first product and the second product comprises liquid.

23. The device according to claim 22, wherein at least the second product comprises liquid.

24. The device according to claim 1, wherein the sealing arrangement comprises a shutter, the shutter being configured to be moved to enable the flow communication of the first compartment and the second compartment.

25. The device according to claim 1, wherein the first compartment comprises a first coupling member, the second compartment comprises a second coupling member configured to be coupled to the first coupling member.

26. The device according to claim 25, wherein the device is configured so that the sealing arrangement is actuated in response to coupling the first compartment and the second compartment together.

27. A device for mixing at least two products to form a mixture, the device comprising:

a first compartment configured to contain a first product, the first compartment including a dispensing orifice capable of dispensing a mixture of the first product and a second product;

a second compartment configured to contain the second product;

a sealing arrangement isolating the first compartment from the second compartment when the device is in a storage position, the sealing arrangement being actuatable to place the first compartment and the second compartment in flow communication with one another and thereby enable mixing of the first product and the second product to form the mixture, wherein the second compartment comprises a sampling orifice for enabling withdrawal of a sample of the second product from the second compartment prior to the mixing of the first product and the second product; and at least one passage through which at least one of the first product and the second product passes to enable the mixing of the products, and wherein the sampling orifice is separate from the at least one passage, wherein at least one of the first compartment and the second compartment is formed of glass and the other of the first compartment and the second compartment is formed of thermoplastic material.

28. A device for mixing at least two products to form a mixture, the device comprising:

a first compartment configured to contain a first product, the first compartment including a dispensing orifice capable of dispensing a mixture of the first product and a second product;

a second compartment configured to contain the second product;

a sealing arrangement isolating the first compartment from the second compartment when the device is in a storage position, the sealing arrangement being actuatable to place the first compartment and the second compartment in flow communication with one another and thereby enable mixing of the first product and the second product to form the mixture, wherein the second compartment comprises a sampling orifice for enabling withdrawal of a sample of the second product from the second compartment prior to the mixing of the first product and the second product;

at least one passage through which at least one of the first product and the second product passes to enable the mixing of the products, and wherein the sampling orifice is separate from the at least one passage;

a removable closure configured to close the sampling orifice; and an applicator member provided on the closure.

29. The device according to claim 28, further comprising second product contained in the second compartment, wherein the applicator member is at least partially immersed in the second product when the closure closes the sampling orifice.

30. The device according to claim 28, wherein the applicator member is chosen from a spatula, a brush, and a block of porous material.

31. A device for mixing at least two products to form a mixture, the device comprising:

a first product;

a second product, wherein the first product and the second product are different products;

a first compartment containing the first product, the first compartment including a dispensing orifice capable of dispensing a mixture of the first product and the second product;

a second compartment containing the second product, the second compartment being located below the first compartment, wherein the second product contained in the second compartment is not pressurized;

a sealing arrangement isolating the first compartment from the second compartment when the device is in a storage position, the sealing arrangement being actuatable to place the first compartment and the second compartment in flow communication with one another and thereby enable mixing of the first product and the second product to form the mixture, wherein a sampling orifice is formed on one of the first compartment and the second compartment, wherein the sampling orifice enables withdrawal of one of a sample of the first product from the first compartment and a sample of the second product from the second compartment prior to the mixing of the first product and the second product; and at least one passage through which at least one of the first product and the second product passes to enable the mixing of the products, wherein the sampling orifice is separate from the at least one passage.

32. The device according to claim 31, further comprising a removable closure configured to close the sampling orifice.

33. The device according to claim 31, wherein the device has a longitudinal axis, and the sampling orifice is along a second axis separate from the longitudinal axis.

34. The device according to claim 33, wherein the second axis is substantially parallel to the longitudinal axis.

35. The device according to claim 33, wherein the second axis defines an oblique angle with respect to the longitudinal axis.

36. The device according to claim 31, wherein the sampling orifice is provided on the first compartment.

37. The device according to claim 36, wherein the first and second compartments are coupled to one another, and wherein the device is configured such that the sample of the first product is capable of being withdrawn from the first compartment via the sampling orifice while the first compartment and the second compartment are coupled to one another.

38. The device according to claim 31, wherein at least one of the first product, the second product, and the mixture comprises a cosmetic product.

39. The device according to claim 38, wherein the first and second compartments are coupled to one another, and wherein the device is configured such that the sample is capable of being withdrawn via the sampling orifice while the first compartment and the second compartment are coupled to one another.

40. A device for mixing at least two products to form a mixture, the device comprising:

a first compartment configured to contain a first product, the first compartment including a dispensing orifice capable of dispensing a mixture of the first product and a second product;

a second compartment configured to contain the second product, the second compartment being located below the first compartment, wherein the first and second compartments are coupled to one another;

a sealing arrangement isolating the first compartment from the second compartment when the device is in a storage position, the sealing arrangement being actuatable to place the first compartment and the second compartment in flow communication with one another and thereby enable mixing of the first product and the second product to form the mixture, wherein a sampling orifice is formed on one of the first compartment and the second compartment, wherein the sampling orifice enables withdrawal of one of a sample of the first product from the first compartment and a sample of the second product from the second compartment prior to the mixing of the first product and the second product; and at least one passage through which at least one of the first product and the second product passes to enable the mixing of the products, wherein the sampling orifice is separate from the at least one passage, wherein the device is configured such that the sample is capable of being withdrawn via the sampling orifice while the first compartment and second compartment are coupled to one another.

41. The device according to claim 40, wherein the first compartment comprises a first coupling member, the second compartment comprises a second coupling member configured to be coupled to the first coupling member.

42. The device according to claim 41, wherein the device is configured so that the sealing arrangement is actuated in response to coupling the first compartment and the second compartment together.

43. A device for mixing at least two products to form a mixture, the device comprising:

a first compartment configured to contain a first product, the first compartment including a dispensing orifice capable of dispensing a mixture of the first product and a second product;

a second compartment configured to contain the second product, the second compartment being located below the first compartment;

a sealing arrangement isolating the first compartment from the second compartment when the device is in a storage position, the sealing arrangement being actuatable to place the first compartment and the second compartment in flow communication with one another and thereby enable mixing of the first product and the second product to form the mixture, wherein the second compartment comprises a sampling orifice for enabling withdrawal of a sample of the second product from the second compartment prior to the mixing of the first product and the second product, wherein the first and second compartments are coupled to one another, and wherein the device is configured such that the sample of the second product is capable of being withdrawn via the sampling orifice while the first compartment and the second compartment are coupled to one another.

44. The device according to claim 43, wherein the first compartment comprises a first coupling member, the second compartment comprises a second coupling member configured to be coupled to the first coupling member.

45. The device according to claim 44, wherein the device is configured so that the sealing arrangement is actuated in response to coupling the first compartment and the second compartment together.

46. A device for mixing at least two products to form a mixture, the device comprising:

a first compartment configured to contain a first product, the first compartment including a dispensing orifice capable of dispensing a mixture of the first product and a second product;

a second compartment configured to contain the second product;

a sealing arrangement isolating the first compartment from the second compartment when the device is in a storage position, the sealing arrangement being actuatable to place the first compartment and the second compartment in flow communication with one another and thereby enable mixing of the first product and the second product to form the mixture, wherein the second compartment comprises a sampling orifice for enabling withdrawal of a sample of the second product from the second compartment prior to the mixing of the first product and the second product; and an applicator member configured to pass through the sampling orifice to withdraw the sample.

47. The device according to claim 46, further comprising a removable closure configured to close the sampling orifice, and wherein the applicator member is provided on the closure.

48. The device according to claim 47, further comprising second product contained in the second compartment, wherein the applicator member is at least partially immersed in the second product when the closure closes the sampling orifice.

49. The device according to claim 48, wherein the applicator member is chosen from a spatula, a brush, and a block of porous material.

50. A device for mixing at least two products to form a mixture, the device comprising:

a first compartment configured to contain a first product, the first compartment including a dispensing orifice capable of dispensing a mixture of the first product and a second product;

a second compartment configured to contain the second product, the second compartment being located below the first compartment; and a sealing arrangement isolating the first compartment from the second compartment when the device is in a storage position, the sealing arrangement being actuatable to place the first compartment and the second compartment in flow communication with one another and thereby enable mixing of the first product and the second product to form the mixture, wherein a sampling orifice is formed on one of the first compartment and the second compartment, wherein the sampling orifice enables withdrawal of one of a sample of the first product from the first compartment and a sample of the second product from the second compartment prior to the mixing of the first product and the second product, wherein the first and second compartments are coupled to one another, and wherein the device is configured such that the sample is capable of being withdrawn via the sampling orifice while the first compartment and second compartment are coupled to one another.

51. The device according to claim 50, wherein the first compartment comprises a first coupling member, the second compartment comprises a second coupling member configured to be coupled to the first coupling member.

52. The device according to claim 51, wherein the device is configured so that the sealing arrangement is actuated in response to coupling the first compartment and the second compartment together.

53. A device for mixing at least two products to form a mixture, the device comprising:

a first compartment configured to contain a first product, the first compartment including a dispensing orifice capable of dispensing a mixture of the first product and a second product;

a second compartment configured to contain the second product;

a sealing arrangement isolating the first compartment from the second compartment when the device is in a storage position, the sealing arrangement being actuatable to place the first compartment and the second compartment in flow communication with one another and thereby enable mixing of the first product and the second product to form the mixture, wherein a sampling orifice is formed on one of the first compartment and the second compartment, wherein the sampling orifice enables withdrawal of one of a sample of the first product from the first compartment and a sample of the second product from the second compartment prior to the mixing of the first product and the second product; and an applicator member configured to pass through the sampling orifice to withdraw the sample.

54. The device according to claim 53, further comprising a removable closure configured to close the sampling orifice, and wherein the applicator member is provided on the closured.

55. A method of sampling a product prior to mixture of the product with at least one other product, the method comprising:

providing a device for mixing at least two products to form a mixture, the device comprising a first compartment containing a first product, the first compartment including a dispensing orifice capable of dispensing a mixture of the first product and a second product, a second compartment containing the second product, and a sealing arrangement isolating the first compartment from the second compartment when the device is in a storage position, the sealing arrangement being actuatable to place the first compartment and the second compartment in flow communication with one another and thereby enable mixing of the first product and the second product to form the mixture, wherein the second compartment comprises a sampling orifice for enabling withdrawal of a sample of the second product from the second compartment prior to the mixing of the first product and the second product; and withdrawing from the second compartment a sample of the second product via the sampling orifice.

56. The method according to claim 55, wherein the withdrawing comprises removing the sample of the second product from the second compartment with an applicator member, and wherein the method further comprises applying the sample of the second product to a test surface with the applicator member.

57. The method according to claim 55, further comprising applying the sample of second product to a test surface, wherein the test surface comprises at least one of skin and hair.

58. The method according to claim 55, wherein at least one of the second product and the mixture of the first and second products comprises a cosmetic product.

59. The method according to claim 58, wherein the first product comprises an oxidizing agent, the second product comprises a dye, and the mixture comprises a hair dye composition.

60. A method of sampling a product and mixing the product with another product to form a mixture, the method comprising:

sampling the second product according to the method of claim 55;

actuating the sealing arrangement to place the first compartment and the second compartment in flow communication;

mixing the first product and the second product to form the mixture; and dispensing the mixture through the dispensing, orifice.

61. The method according to claim 60, wherein the mixture comprises a hair composition.

62. The method according to claim 61, wherein the hair composition comprises a dye composition and the second product comprises a dye.

63. A method of sampling a product prior to mixture of the product with at least one other product, the method comprising:

providing a device for mixing at least two products to form a mixture, the device comprising a first compartment containing a first product, the first compartment including a dispensing orifice capable of dispensing a mixture of the first product and a second product, a second compartment containing the second product, and a sealing arrangement isolating the first compartment from the second compartment when the device is in a storage position, the sealing arrangement being actuatable to place the first compartment and the second compartment in flow communication with one another and thereby enable mixing of the first product and the second product to form the mixture, wherein a sampling orifice is formed on one of the first compartment and the second compartment, wherein the sampling orifice enables withdrawal of one of a sample of the first product from the first compartment and a sample of the second product from the second compartment prior to the mixing of the first product and the second product; and withdrawing the sample via the sampling orifice.

64. The method according to claim 63, wherein the withdrawing comprises removing the sample with an applicator member, and wherein the method further comprises applying the sample to a test surface with the applicator member.

65. The method according to claim 63, further comprising applying the sample to a test surface, wherein the test surface comprises at least one of skin and hair.

66. The method according to claim 63, wherein at least one of the first product, the second product, and the mixture of the first and second products comprises a cosmetic product.

67. The method according to claim 66, wherein the first product comprises an oxidizing agent, the second product comprises a dye, and the mixture comprises a hair dye composition.

68. The method according to claim 63, wherein sample comprises a sample of the first product.

69. A method of sampling a product and mixing the product with another product to form a mixture, the method comprising:

sampling one of the first product and the second product according to the method of claim 63;

actuating the sealing arrangement to place the first compartment and the second compartment in flow communication;

mixing the first product and the second product to form the mixture; and dispensing the mixture through the dispensing orifice.

70. The method according to claim 69, wherein the mixture comprises a hair composition.

71. The method according to claim 70, wherein the hair composition comprises a dye composition and the second product comprises a dye.

* * * * *

UNITED STATES PATENT AND TRADEMARK OFFICE

CERTIFICATE OF CORRECTION

PATENT NO. : 6,543,645 B2
DATED : April 8, 2003
INVENTOR(S) : Frank Lacout

It is certified that error appears in the above-identified patent and that said Letters Patent is hereby corrected as shown below:

Column 14,
Line 34, please replace “closured” with -- closure --.

Column 15,
Line 18, please replace “dispensing, orifice” with -- dispensing orifice --.

Signed and Sealed this

First Day of July, 2003

JAMES E. ROGAN
*Director of the United States Patent and Trademark Office*